US006519433B1

(12) United States Patent
Hirabayashi et al.

(10) Patent No.: US 6,519,433 B1
(45) Date of Patent: Feb. 11, 2003

(54) IMAGE FORMING APPARATUS IN WHICH ELECTROCONDUCTIVE PARTICLES ARE SUPPLIED TO CHARGING MEANS FROM DEVELOPING DEVICE BY WAY OF IMAGE BEARING MEMBER

(75) Inventors: Jun Hirabayashi, Numazu (JP); Harumi Ishiyama, Numazu (JP); Yasunori Chigono, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/678,026

(22) Filed: Oct. 4, 2000

(30) Foreign Application Priority Data

Oct. 8, 1999 (JP) ..... 11-287924

(51) Int. Cl.[7] ..... G03G 15/02
(52) U.S. Cl. ..... 399/174; 399/150; 399/176
(58) Field of Search ..... 399/174, 175, 399/176, 150; 361/225

(56) References Cited

U.S. PATENT DOCUMENTS

| | | | | |
|---|---|---|---|---|
| 4,851,960 A | | 7/1989 | Nakamura et al. | 361/225 |
| 5,432,037 A | | 7/1995 | Nishikiori et al. | 430/126 |
| 5,809,379 A | | 9/1998 | Yano et al. | 399/159 |
| 5,852,758 A | * | 12/1998 | Wibbels | 399/176 |
| 6,038,418 A | | 3/2000 | Chigono et al. | 399/174 |
| 6,038,420 A | | 3/2000 | Hirabayashi et al. | 399/176 |
| 6,081,681 A | | 6/2000 | Nagase et al. | 399/174 |
| 6,118,965 A | | 9/2000 | Hirabayashi et al. | 399/175 |
| 6,128,456 A | | 10/2000 | Chigono et al. | 399/176 |
| 6,134,407 A | | 10/2000 | Ishiyama et al. | 399/174 |
| 6,226,480 B1 | * | 5/2001 | Hirabayashi et al. | 399/174 X |

FOREIGN PATENT DOCUMENTS

| | | | |
|---|---|---|---|
| EP | 0 864 936 | | 9/1998 |
| JP | 5-150539 | | 6/1993 |
| JP | 6-3921 | | 1/1994 |
| JP | 7-110613 | | 4/1995 |
| JP | 7-99442 | | 10/1995 |
| JP | 11-65233 | | 3/1999 |
| JP | 11-153897 | * | 6/1999 |

OTHER PUBLICATIONS

U.S. Patent Application No. 09/387,568, filed Sep. 1, 1999.

* cited by examiner

*Primary Examiner*—Joan Pendegrass
(74) *Attorney, Agent, or Firm*—Fitzpatrick, Cella, Harper & Scinto

(57) ABSTRACT

An image forming apparatus includes an image bearing member; charging means for electrically charging the image bearing member, the charging means carrying electroconductive particles and having a charging member elastially press-contacted to the image bearing member; image forming means for forming an electrostatic image by selectively dissipating electric charge on the image bearing member charged by the charging means; developing means for developing the electrostatic image on the image bearing member with toner and for supplying the electroconductive particles to the image bearing member, wherein the electroconductive particles supplied by the developing means is carried to a press-contact portion of the charging member to contribution for electric charging of the image bearing member; and changing means for changing a relation between the charging member and a supply position of the electroconductive particles of the developing means.

10 Claims, 5 Drawing Sheets

(c) PATTERN

OUTPUT

| | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| 1 | 42 | 17 | 95 | 46 | 35 | 47 | 2 | 64 | 87 | 87 | 73 | 61 | 26 | 59 | 58 | 27 | 89 | 40 |
| 2 | 57 | 50 | 34 | 73 | 18 | 26 | 9 | 35 | 23 | 76 | 10 | 99 | 69 | 14 | 44 | 26 | 9 | 35 |
| 3 | 4 | 41 | 37 | 94 | 94 | 76 | 47 | 16 | 39 | 98 | 26 | 92 | 87 | 3 | 63 | 58 | 9 | 4 |
| 4 | 18 | 98 | 24 | 34 | 93 | 88 | 24 | 91 | 40 | 59 | 52 | 64 | 83 | 19 | 1 | 17 | 68 | 38 |
| 5 | 8 | 69 | 13 | 79 | 56 | 26 | 78 | 42 | 5 | 8 | 18 | 51 | 56 | 40 | 97 | 90 | 43 | 56 |
| 6 | 55 | 22 | 1 | 30 | 90 | 45 | 47 | 12 | 24 | 91 | 99 | 32 | 15 | 58 | 13 | 19 | 1 | 46 |
| 7 | 64 | 90 | 69 | 7 | 44 | 85 | 89 | 91 | 30 | 88 | 46 | 59 | 34 | 9 | 4 | 94 | 43 | 44 |
| 8 | 23 | 57 | 92 | 93 | 39 | 23 | 48 | 69 | 2 | 48 | 80 | 41 | 85 | 87 | 53 | 32 | 65 | 99 |
| 9 | 82 | 5 | 6 | 97 | 19 | 85 | 36 | 84 | 20 | 89 | 80 | 61 | 22 | 64 | 34 | 20 | 89 | 0 |
| 10 | 41 | 99 | 9 | 36 | 66 | 83 | 31 | 36 | 74 | 47 | 42 | 76 | 21 | 31 | 58 | 25 | 51 | 10 |
| 11 | 1 | 70 | 53 | 27 | 14 | 87 | 10 | 53 | 41 | 13 | 87 | 66 | 6 | 75 | 46 | 28 | 23 | 61 |
| 12 | 16 | 92 | 60 | 58 | 50 | 88 | 52 | 11 | 72 | 98 | 68 | 24 | 34 | 29 | 52 | 58 | 20 | 25 |
| 13 | 81 | 1 | 23 | 54 | 61 | 87 | 20 | 2 | 41 | 61 | 9 | 78 | 70 | 29 | 4 | 92 | 11 | 74 |
| 14 | 36 | 97 | 87 | 81 | 37 | 81 | 82 | 53 | 98 | 5 | 41 | 87 | 8 | 84 | 18 | 26 | 80 | 41 |
| 15 | 9 | 92 | 80 | 42 | 73 | 5 | 9 | 36 | 30 | 77 | 59 | 93 | 4 | 59 | 15 | 10 | 44 | 24 |
| 16 | 44 | 53 | 65 | 45 | 37 | 12 | 90 | 55 | 45 | 54 | 1 | 9 | 24 | 48 | 33 | 81 | 78 | 96 |
| 17 | 64 | 7 | 40 | 95 | 67 | 7 | 59 | 85 | 63 | 63 | 1 | 55 | 85 | 33 | 90 | 13 | 93 | 16 |
| 18 | 97 | 7 | 79 | 1 | 75 | 34 | 60 | 63 | 13 | 57 | 59 | 70 | 64 | 74 | 2 | 81 | 49 | 34 |
| 19 | 36 | 4 | 78 | 51 | 50 | 54 | 96 | 24 | 59 | 7 | 10 | 24 | 17 | 68 | 25 | 10 | 80 | 31 |
| 20 | 10 | 32 | 45 | 75 | 34 | 42 | 86 | 78 | 45 | 16 | 43 | 7 | 24 | 20 | 87 | 53 | 27 | 90 |
| 21 | 28 | 81 | 27 | 50 | 7 | 82 | 99 | 89 | 72 | 86 | 87 | 96 | 31 | 98 | 78 | 67 | 68 | 43 |
| 22 | 18 | 57 | 34 | 52 | 83 | 1 | 74 | 44 | 40 | 11 | 99 | 43 | 51 | 19 | 76 | 52 | 60 | 47 |
| 23 | 9 | 19 | 61 | 97 | 72 | 92 | 27 | 43 | 54 | 3 | 22 | 86 | 60 | 95 | 34 | 62 | 0 | 24 |
| 24 | 29 | 21 | 35 | 5 | 16 | 69 | 21 | 20 | 75 | 17 | 35 | 53 | 10 | 24 | 51 | 96 | 68 | 48 |
| 25 | 37 | 58 | 67 | 67 | 4 | 32 | 14 | 43 | 36 | 78 | 73 | 71 | 71 | 46 | 49 | 25 | 91 | 31 |
| 26 | 58 | 84 | 62 | 76 | 41 | 3 | 73 | 93 | 94 | 100 | 16 | 25 | 32 | 70 | 41 | 17 | 90 | 25 |
| 27 | 84 | 89 | 22 | 96 | 2 | 22 | 83 | 100 | 11 | 77 | 87 | 4 | 94 | 94 | 83 | 16 | 68 | 75 |
| 28 | 88 | 69 | 61 | 81 | 74 | 73 | 14 | 35 | 75 | 64 | 64 | 74 | 52 | 45 | 23 | 55 | 20 | 32 |
| 29 | 46 | 43 | 38 | 55 | 63 | 35 | 85 | 96 | 91 | 62 | 76 | 90 | 50 | 8 | 36 | 56 | 97 | 32 |
| SUM | 1, 194 | 1, 513 | 1, 398 | 1, 708 | 1, 414 | 1, 468 | 1, 465 | 1, 563 | 1, 398 | 1, 621 | 1, 464 | 1, 691 | 1, 264 | 1, 412 | 1, 269 | 1, 308 | 1, 535 | 1, 224 |

IMAGE FORMING APPARATUS IN WHICH ELECTROCONDUCTIVE PARTICLES ARE SUPPLIED TO CHARGING MEANS FROM DEVELOPING DEVICE BY WAY OF IMAGE BEARING MEMBER

FIELD OF THE INVENTION AND RELATED ART

The present invention relates to an image forming apparatus such as a copying machine, a printer or the like using an electrophotographic process or electrostatic recording system, and more particularly to an image forming apparatus using a contact charging mechanism with electroconductive particles.

Heretofore, a corona discharging apparatus (corona type charging device) has been widely used as a charging apparatus for charging an image bearing member (member to be charged), for example, an electrophotographic photosensitive member, an electrostatically recordable dielectric member, or the like, in an image forming apparatus, for example, an electrophotographic apparatus, an electrostatic recording apparatus, or the like, to predetermined polarity and potential level.

A corona discharging apparatus is a noncontact type charging apparatus. It comprises an ion discharging electrode constituted of a piece of wire or the like, and an electrode in the form of a shield which surrounds the ion discharging electrode. The shield electrode is provided with an ion discharging opening directed toward the surface of an object to be charged, but, not in contact with the object. In operation, high voltage is applied to the ion discharging electrode and the shield electrode to generate discharge current (corona shower) to which the surface of the object is exposed to be charged to predetermined polarity and potential level.

In recent years, however, a substantial number of contact type charging apparatuses have been proposed, and some of them have been put to practical use as a charging apparatus because of their advantages over a corona type charging apparatus; for example, they are smaller in the amount of ozone production and power consumption.

A contact type charging apparatus comprises an electrically conductive charging member in the form of, for example, a roller (charge roller), a fur brush, a magnetic brush, or a blade, which is placed in contact with a member to be charged, for example, an image bearing member or the like. In operation, charge bias, or electrical voltage with a predetermined potential level, is applied to the contact charging member, which is placed in contact with a member to be charged, for example, an image bearing member or the like, so that the peripheral surface of the object to be charged is charged to predetermined polarity and electrical potential.

The charging mechanism (charging principle) in a contact type charging apparatus comprises a mixture of two charging mechanisms: (1) a mechanism based on electrical discharge, and (2) a mechanism based on injection of electrical charge. Thus, the characteristics of a contact type charging apparatus vary depending on which of the two mechanisms is dominant.

(1) Charging Mechanism Based on Electrical Discharge

This is a charging mechanism which charges the peripheral surface of an object to be charged, with the use of the products generated by the electrical discharge which occurs between a contact type charging member and the object to be charged.

In a charging system based on electrical discharge, there is a threshold value. Thus, in order for an object to be charged to a predetermined potential level, voltage, the potential level of which is greater than the predetermined voltage level, must be applied to a contact type charging member. In addition, an electrical discharge based charging system inherently produces by-products, the amount of which, however, may be drastically small compared to those produced by a corona based charging device. Therefore, even if a contact type charging system is employed, it is impossible to completely avoid the problems caused by active ions such as ozone.

(2) Mechanism Based on Electrical Charge Injection

This is a charging mechanism which directly injects electrical charge into an object from a contact charging member so that the peripheral surface of the object is electrically charged. It is called the charging system or a charge injection charging system. More specifically, a contact type charging member, the electrical resistance of which is in a medium range, is placed in contact with the peripheral surface of an object to be charged, to charge the object without triggering the electrical discharge. In other words, this charging mechanism is a charging mechanism which directly injects electrical charge into the peripheral surface of an object to be charged. Principally, it does not rely on electrical discharge. Therefore, even if the potential level of the voltage applied to a contact type charging member is less than a threshold voltage level, the object to be charged can be charged to a:potential level substantially equal to the potential level of the applied voltage.

Since this injection charging system does not involve ion generation, it does not suffer from the ill effects associated with the by-products of electrical discharge. However, since a contact type charging system is an injection system, its performance is greatly affected by the state of contact between a contact type charging member and an object to be charged. Thus, it is very important that a contact type charging member is high in density, that there is provided a sufficient amount of difference in surface velocity between the charging member and the object charged, and that the contact type charging member makes contact with the object to be charged, with a sufficiently high frequency.

A) Charging by Roller

A contact type charging apparatus which employs a roller type charging method, in other words, it employs an electrically conductive roller (charge roller) as a contact type charging member. It has been widely used because of its safety.

In the case of a charging roller, the charging mechanism based on electrical discharge (1) is the dominant charging mechanism.

A charge roller is formed of rubber or foamed material which is electrically conductive, or the electrical resistance of which is in the medium range. Sometimes, different materials are layered in order to obtain a predetermined characteristic.

A charge roller is provided with elasticity so that a predetermined state of contact can be kept between the charge roller and an object to be charged (hereinafter, photosensitive member). Therefore, a charger roller is given a large frictional resistance on its peripheral surface. Generally, it is enabled to follow the rotation of a photosensitive member, or is driven at a speed slightly different from that of the photosensitive member. Thus, when a charge roller is used to inject electrical charge into a photosensitive member, it cannot be avoided that the charge roller is deteriorated in its absolute performance and/or the state of contact between itself and the photosensitive drum by the contaminants adhered to the charge roller and/or the photosensitive member, and as a result, the photosensitive member is nonuniformly charged, in spite of the fact that a charge roller is a contact type charging member. In other words, in the case of a conventional charging roller, the charging mechanism based on electrical discharge is dominant in charging the photosensitive member.

FIG. 5 is a graph which shows the efficiencies of various contact type charging members. The abscissas represents the potential level of the bias applied to a contact type charging member, and the ordinate represents the correspondent potential level of a photosensitive member. The characteristic of a conventional charge roller is depicted by a line A. In other words, the charging of the photosensitive drum begins when the potential level of the voltage applied to the charge roller passes the threshold value of approximately −500 V. Therefore, generally, in order to charge a photosensitive drum to a potential level of −500 V, either a DC voltage of −1,000 V is applied to the charge roller, or an AC voltage with a peak-to-peak voltage of 1,200 V is applied to the charge roller, in addition to a DC voltage of −500 V, so that a difference in potential level greater than the threshold voltage value is always present between the charge roller and the photosensitive drum, and the potential level of the photosensitive drum converges to the predetermined potential level, −500 V.

To describe in more detail, when a charge roller is placed in contact with a photosensitive drum with a 25 $\mu$m thick photoconductor layer, the surface potential level of the photosensitive drum begins to rise as the potential level of the voltage applied to the charge roller is increased beyond approximately 640 V. Beyond 640 V, the surface potential level of the photosensitive drum linearly increases at an inclination of 1. This threshold potential level is defined as a charge initiation voltage Vth.

In other words, in order to increase the surface potential level of a photosensitive drum to a potential level of Vd, a DC voltage with a potential level of Vd+Vth, which is greater than the target surface potential level for the photosensitive drum, is necessary. This method in which only DC voltage is applied to a contact type charging member to charge an object is called a DC charge system.

However, it is rather difficult to change the value of the potential level of a photosensitive member to a desired value with the use of a DC charge system, because the resistance value of a contact type charging member varies due to changes in ambience, and also because the value of Vth changes as the thickness of the surface layer of the photosensitive member (image bearing member) changes as it is shaved.

Thus, various proposals to uniformly and reliably charge a photosensitive drum have been made. Among such proposals, U.S. Pat. No. 4,851,960 discloses an AC charge system, according to which a compound voltage composed of a DC voltage equivalent to a desired potential level and an oscillating AC voltage with a peak-to-peak voltage of 2×Vth is applied to a contact type charging member. This proposal intended that AC voltage be used to make the potential level uniform. As a result, the potential level of an object to be charged converges to the voltage value of Vd, the center of the top and bottom peaks of the AC voltage, which is not affected by external disturbance such as changes in ambience.

However, even in the case of such a contact type charging apparatus as the one described above, its charging mechanism principally relies on the electrical discharge. Therefore, the potential level of the voltage applied to a contact type charging member needs to have a value greater than the value of the potential level to which a photosensitive drum is to be charged. As a result, ozone is produced, although the amount is microscopic.

Further, when an AC charge system is used for the uniformity of charge, an additional amount of ozone is generated, and the contact type charging member and the photosensitive member are vibrated by the electric field generated by the AC voltage, which results in noises (AC charge noises). Further, the deterioration or the like of the peripheral surface of the photosensitive drum is very severe. These are new problems.

B) Charging by Fur Brush

In this charging method, a member with a brush portion formed of electrically conductive fibrous material is used as a contact type charging member (fur brush type charging device). In operation, the brush portion formed of electrically conductive fibrous material is placed in contact with a photosensitive member as an object to be charged, and charge bias with a predetermined potential level is applied to the brush portion to charge the peripheral surface of the photosensitive drum to predetermined polarity and potential level.

Also in the case of this fur brush type charging system, the dominant charging mechanism is the aforementioned charging mechanism based on electrical discharge (1).

There are two fur brush type charging devices which have been put to practical use: a fixed type, and a roller type. The former comprises a piece of pile composed by weaving fibrous material with an electrical resistance in an intermediary range, into base cloth, and attaching electrodes to the pile, whereas the latter comprises a metallic core and a piece of pile, similar to the one for the fixed fur brush type charging device, wrapped around the metallic core. As for the pile, those with a fiber density of approximately 100 strands/mmSUP2/SUP can be relatively obtainable. However, in order to charge a photosensitive member in a sufficiently uniform manner by the injection of electrical charge, such a fiber density is not high enough to maintain a satisfactory state of contact between the charging member and the photosensitive drum. Thus, it is necessary to provide between the peripheral surfaces of the charging member and photosensitive member such a velocity difference that is impossible to mechanically realize, which is not practical.

The characteristics of a fur brush type charging device when DC voltage is applied are depicted by a line B in FIG. 5. In other words, also in the case of a fur brush type charging device, whether it is of a fixed type or a roller type, a photosensitive drum is charged mostly through electrical charge generated by the application of charge bias with a potential level higher than the target potential level.

C) Charging by Magnetic Brush

In this charging method, a magnetic brush, that is, electrically conductive magnetic particles magnetically confined in the form of a brush on a magnetic roller or the like, is used as a contact type charging member. In operation, a magnetic brush is placed in contact with a photosensitive member, and charge bias with a predetermined potential level is applied to charge the peripheral surface of the photosensitive drum as an object to be charged, to predetermined polarity and potential level.

In the case of a magnetic brush type charging device, the dominant charging mechanism is the injection charging mechanism (2).

When electrically conductive magnetic particles ranging 5–50 $\mu$m in diameter are used to form the magnetic brush, and a sufficient amount of difference in peripheral surface velocity is provided between the magnetic brush and a photosensitive drum, the photosensitive drum can be uniformly charged by the direct charge injection.

As is depicted by a line C in FIG. 5, that is, the graph which shows the characteristics of various types of charging devices, this magnetic brush type charging device can charge a photosensitive drum to a potential level substantially proportional to the potential level of the bias applied to a charging member.

However, this device also has its own problems. For example, it is complicated in structure, and some of the electrically conductive magnetic particles, of which the magnetic brush is composed, fall off and adhere to a photosensitive drum.

Japanese Patent Laid-Open Application No. 3,921/1994 or the like discloses a method for charging a photosensitive drum by directly injecting electrical charge into the charge retaining portions, for example, the trap levels or electrically conductive particles in the charge injection layer, of the photosensitive drum. This method does not rely on electrical discharge. Therefore, the potential level of the voltage to be applied to a charging member by this method has only to be as high as the potential level to which the photosensitive drum is charged, and also, it does not generate ozone. Further, it does not require the application of AC voltage. Therefore, there is no charging noise. In other words, this method is a superior charging method to a roller type charging method in that it does not produce ozone, and consumes a smaller amount of electrical power.

D) Toner Recycling System (Cleaner-less System)

In a transfer type image recording apparatus, the developing agent (toner) which remains on a photosensitive drum (image bearing member) after image transfer, or residual developing agent (residual toner), is removed from the peripheral surface of the photosensitive drum by a cleaner (cleaning apparatus) and becomes waste toner. From the standpoint of environmental protection, it is desired that waste toner is not produced. Thus, an image recording apparatus which employs a toner recycling system (or toner recycling process) has been realized. In this type of an image recording apparatus, there is no cleaner, and the residual toner which remains on a photosensitive drum after image transfer is removed from the photosensitive drum by a developing apparatus (developing-cleaning process). In other words, the residual toner is recovered by the developing apparatus.

The developing-cleaning process is a method in which the toner remaining on a photosensitive drum after image transfer is recovered by a fog removal bias (difference Vback between potential level of DC voltage applied to developing apparatus and potential level of peripheral surface of photosensitive drum) during the development of a latent image which follows image transfer, that is during the development after the next charging and exposure steps. According to this method, the residual toner is recovered by a developing apparatus and is used in the following image formation cycles. In other words, no toner is wasted; waste toner is not produced, reducing the amount of maintenance labor. Further, being cleaner-less makes a cleaner-less recording apparatus advantageous in terms of space; a cleaner-less recording apparatus can be drastically smaller compared to a recording apparatus with a cleaner.

In the clearnerless system, the residual toner is passed through a charging station and then a developing apparatus, instead of being removed from the peripheral surface of a photosensitive drum by a dedicated cleaner as described previously, so that it can be recycled to be used for the development processes in the following image formation cycles. Thus, a toner recycling system has its own problem, that is, how to properly charge a photosensitive member, with toner which is electrically insulative, being present in the contact portion between the photosensitive drum and a contact type charging member, since when a contact type charging member is employed as a means for charging a photosensitive member in a cleaner-less recording apparatus, the residual toner is definitely present between the photosensitive drum and the contact type charging member. When a photosensitive member is charged by a roller type charging member or a fur brush, the residual toner on the photosensitive drum is evenly scattered to remove the patterns in which the residual toner was distributed, and the photosensitive drum is charged mostly through the electrical discharge caused by the application of relatively large bias. When a magnetic brush is used to charge a photosensitive member, a brush portion composed of electrically conductive magnetic particles, that is, powder, flexibly contacts the photosensitive drum to charge it.

E) Coating of the contact charging member with particles a. Japanese Patent Application Publication No. HEI 7-99442 discloses that in order to accomplish stabilized uniform charging without applying a charge directly from a contact charging device, charged particles are applied on the surface of a contact charging member contactable to the surface of the member to be charged. The contact charging member charging roller is driven by the member to be charged (photosensitive member) and although the amount of the ozone product is remarkably smaller than with the corona charger such as scorotron or the like, the main charging principle is still a discharge type charging mechanism similar to the above-described roller charging. Particularly, when the AC-biased DC voltage is used in order to provide more stabilized uniform charging, the amount of the ozone product due to the electric discharge increases. When the device is used in a long term, or when the cleanerless type image forming apparatus is used in the long-term, the problem arising from the ozone product such as image flow of the like tends to be remarkable.

Japanese Laid-open Patent Application No. HEI 5-150539 discloses an image forming method using contact charging wherein a developer contains at least visualizing particles and electroconductive particles having an average particle size small amount that of the visualizing particles in order to prevent charging defects caused by deposition of the toner particles and/or fine silica particle on the surface of the charging means with repeated image formation in long term. However, the contact charging still uses the discharge type charging mechanism, and therefore, it involves the above described problems.

b. U.S. application Ser. Nos. 09/035,109, 09/035,108, and 09/035,022 disclose that in order to promote the injection charging by an improvement in the contact property with the provision of a peripheral speed difference provided between the member to be charged and the contact charging member, a contact charging member is coated with electroconductive particles (charging-promotion particle), by which the close contactness is accomplished, and therefore, improper charging attributable to insufficient contact is eliminated.

Since the charging property is increased by the application of the charging-promotion particles on the contact charging member, the main function of the contact charging member is to provide a nip relative to the member to be charged and to support (carry) the charging-promotion particles, and the function of the contact charging member is carried out by the charging-promotion particles existing in the nip. Here, the conventionally called "contact charging member in such a system is called "supporting member for charging-promotion particle" (charging-promotion particle supporting member).

In a system in which the charging-promotion particles are applied on the supporting member for the charging particles in the injection charging mechanism using the charging-promotion particles in said E) -b, the amount of the charging-promotion particles carried on the surface of the supporting member for the charging-promotion particles decreases only by application of the charging-promotion particles on the charging-promotion particle supporting member at the initial stage, with a result of deterioration of the charging performance.

Therefore, means for supplying the charging-promotion particles to the charging-promotion particle supporting member is needed. As for such supplying means, a system in which the charging-promotion particles are supplied to the charging portion which is the nip between the image bearing member and the supporting member for the charging-promotion particle by way of the surface of the image bearing member (member to be charged) from the developing device, is advantageous since the developing device can be used as the supplying means for the charging-promotion particles so that downsizing is possible.

In the injection charging mechanism using the charging-promotion particles, the charging-promotion particles function as the contact charging member in effect, and therefore, the system supplying the charging-promotion particles from the developing device to the charging portion, is a new system in the charging-promotion particles which are virtually a contact charging member are always supplied from the developing device.

In such a system wherein the charging-promotion particles which are a contact charging member are supplied from the developing device into the charging portion which is a nip formed between the image bearing member and the charging-promotion particle, it is desirable that charging-promotion particles are supplied to the supporting member for the charging-promotion particles without non-uniformity in the longitudinal direction. When the charging-promotion particles are not supplied with stability, the distribution of the charging-promotion particles are not uniform on the surface of the supporting member for the charging-promotion particles. If not, the charging performance may be locally deteriorated.

However, when the charging-promotion particles are supplied from the developing device to the image bearing member using an electric field, the charging-promotion particles are supplied correspondingly to an image pattern during image formation. Therefore, non-uniform distribution of the charging-promotion particles may result on the surface of the charging-promotion particle supporting member.

SUMMARY OF THE INVENTION

It is a principal object of the present intention to provide an image forming apparatus wherein electric charge is injected into an image bearing member through electroconductive particles.

It is another object of the present intention to provide an image forming apparatus wherein an amount of electroconductive particles on a surface of the charging member is always enough.

It is a further object of the present intention to provide an image forming apparatus wherein local defficiency of the amount of the electroconductive particles is suppressed.

According to an aspect of the present intention, there is provided an image forming apparatus, includes an image bearing member; charging means for electrically charging said image bearing member, said charging means carrying electroconductive particles and having a charging member elastially press-contacted to said image bearing member; image forming means for forming an electrostatic image by selectively dissipating electric charge on said image bearing member charged by said charging means; developing means for developing the electrostatic image on said image bearing member with toner and for supplying the electroconductive particles to said image bearing member, wherein the electroconductive particles supplied by said developing means is carried to a press-contact portion of said charging member to contribution for electric charging of said image bearing member; and changing means for changing a relation between said charging member and a supply position of the electroconductive particles of said developing means.

DESCRIPTION OF THE PREFERRED EMBODIMENTS

Hereinafter, preferred embodiments of the present invention will be described with reference to the appended drawings.

Figure 1:
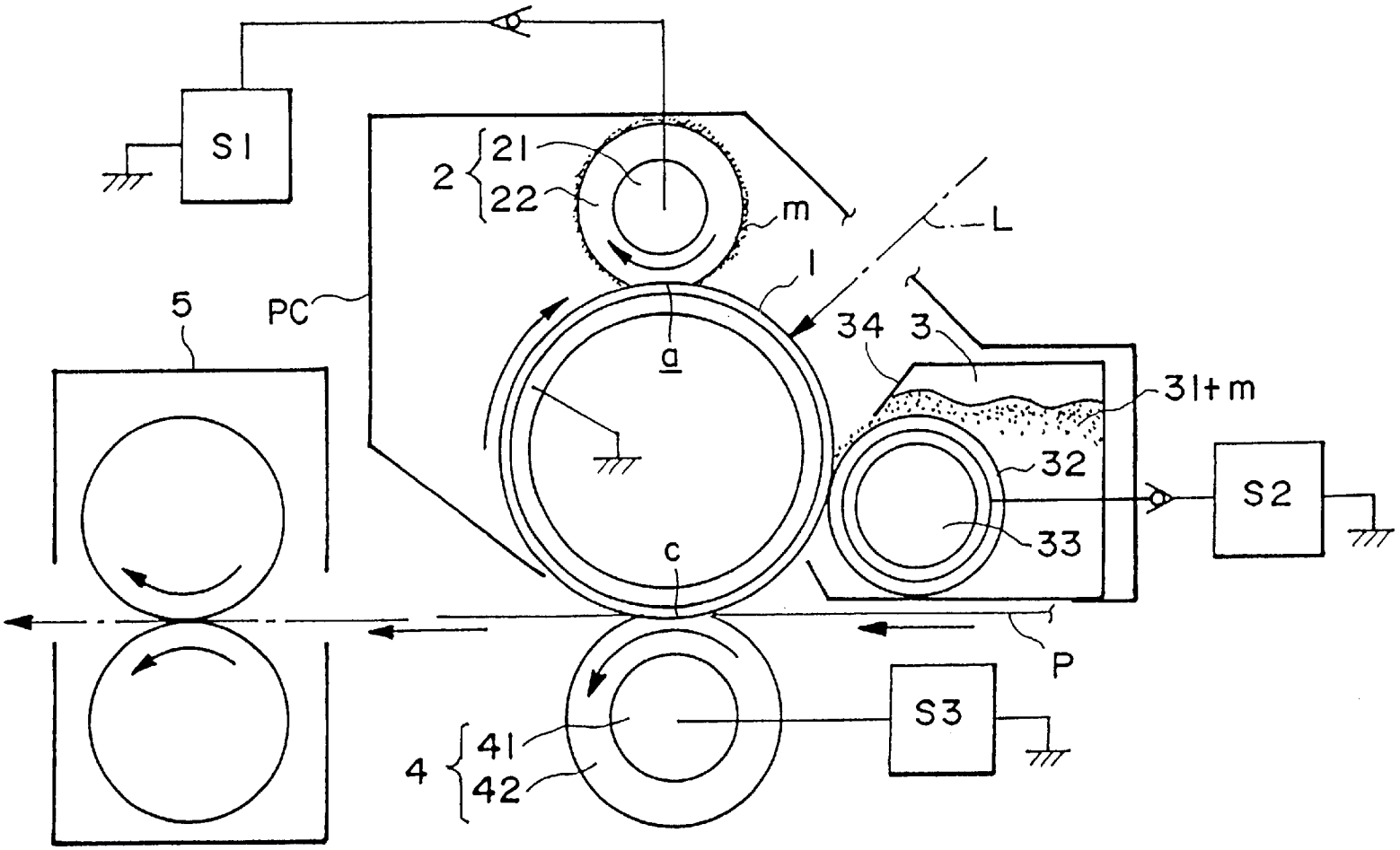
FIG. 1 is a schematically illustration of an image forming apparatus according to Embodiment 1.
Figure 2:
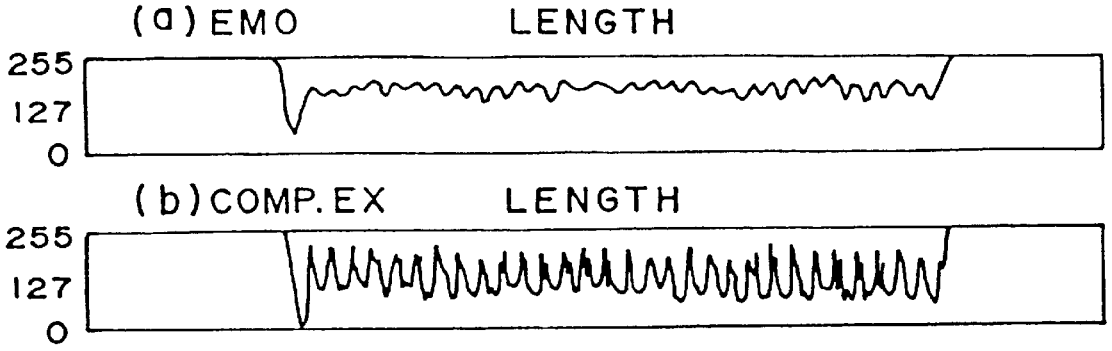
FIG. 2(*a*) shows a distribution of an amount of the charging promotion particles on a surface of a charging roller along a length of the charging roller in an image forming apparatus according to Embodiment 1, and (*b*) shows a distribution of an amount of the charging promotion particles on a surface of a charging roller along a length of the charging roller in a conventional image forming apparatus, and (*c*) is an image pattern printed.

<Embodiment 1> (FIGS. 1 and 2)

FIG. 1 is a schematic sectional view of an example of an image forming apparatus in accordance with the present invention, and depicts the general structure of the apparatus.

The image forming apparatus in this embodiment is a cleaner-less laser printer which employs a transfer type electrophotographic process, a charge injection system, and a process cartridge system.

The image forming apparatus in this embodiment is distinctive in that charging performance enhancement particles are mixed into the developer in a developing apparatus (developing means), from which the charging performance enhancement particles are supplied into a nip (charging station) between a photosensitive member and a charging performance enhancement particle bearing member by way of the peripheral surface of the photosensitive member. Further, the position of the range across which image forming information is written through an exposing process is shifted in the longitudinal direction of the photosensitive member for every copy, to vary the pattern in which the charging performance enhancement particles are distributed in the charge nip in terms of the longitudinal direction of the nip, so that the distribution of the charging performance enhancement particles on the charging performance enhancement particle bearing member becomes uniform in terms of the longitudinal direction of the nip, that is, the longitudinal direction of the charging performance enhancement particle bearing member.

(General Structure of Printer)

[Image Bearing Member]

A referential numeral 1 designates an electrophotographic photosensitive member in the form of a rotational drum as an image bearing member (object to be charged). The printer in this embodiment employs a reversal development system, and therefore, the photosensitive material of the photosensitive member 1 is a negatively chargeable photosensitive material. The photosensitive member 1 in this embodiment is 30 mm in diameter, and its photosensitive material is organic photoconductor. It is rotationally driven in the clockwise direction indicated by an arrow mark at a peripheral velocity of 94 mm/sec.

[Charging Process]

A referential numeral 2 designates an electrically conductive elastic roller (hereinafter, charge roller) as a charging performance enhancement particle bearing member, which is kept in contact with the photosensitive member 1 with the application of a predetermined amount of pressure.

Designated by an alphabetic character a is nip (hereinafter, charge nip) between the photosensitive member 1 and charger roller 2. The peripheral surface of the charge roller 2 is pre-coated with charging performance enhancement particles m, and therefore, a certain amount of the charging performance enhancement particles is present in the charge nip a.

The charge roller 2 is rotationally driven at the same peripheral velocity as the photosensitive member 1 in such a manner that the moving direction of the peripheral surface of the charge roller 2 in the charge nip a becomes opposite to the moving direction of the peripheral surface of the photosensitive member 1 in the charge nip a, causing the peripheral surface of the charge roller 2 to move relative to the peripheral surface of the photosensitive member 1 in the charge nip a as the two peripheral surfaces makes contact with each other in the charge nip a.

To the charge roller 2, a predetermined charge bias is applied from a charge bias power source. As a result, electrical charge is injected into the peripheral surface of the photosensitive member 1 to uniformly charge it to predetermined polarity and potential level.

In this embodiment, charge bias is applied to the charge roller 2 from a charge bias power source S1 so that the peripheral surface of the photosensitive member 1 is uniformly charged to a potential level of approximately 700 V as the photosensitive member 1 rotates.

The charge roller 2, charging performance enhancement particles m, charge injection, and the like, will be described in detail in separate sections.

[Exposing Process]

As the photosensitive member 1 is further rotated, the uniformly charged surface of the photosensitive member 1 is exposed to scanning laser beam L outputted from an unillustrated laser scanner comprising a laser diode, a polygon mirror, and the like. The laser beam L is modulated in intensity with sequential electrical digital image signals which reflect the image information of a target image. Therefore, as the uniformly charged peripheral surface of the photosensitive member 1 is exposed to the laser beam L as the photosensitive member 1 is rotated, an electrostatic latent image reflecting the image information of the target image is formed on the peripheral surface of the photosensitive member 1 as the photosensitive member 1 is rotated.

[Developing Process]

A referential numeral 3 designates a reversal and noncontact type developing apparatus. The electrostatic latent image having been formed on the peripheral surface of the photosensitive member 1 is developed in reverse into a developer image (toner image) by this developing apparatus 3.

The developing apparatus 3 in this embodiment uses, as developer 31, negatively chargeable single component magnetic developer, which is dielectric and is 6 $\mu$m in average particle diameter.

In the developer 31, the charging performance enhancement particles have been mixed, and the amount of the charging performance enhancement particles mixed within the developer 31 is 2 portions per weight for 100 portions of the developer 31. However, the mixing ratio is not limited to the one employed in this embodiment.

The developer 31 in this embodiment is dielectric developer with a volumetric resistivity of approximately $10^{13}$ ohm-cm, and is formed in the following manner. Magnetite, monoazoic dye, and metallic complex as negative charge controller, are mixed into bonding resin, which is mainly copolymer of styrene and acrylic resin. The weight ration between magnetite and metallic complex is 60:1. After the production of the developer 31, microscopic particles of hydrophilic silica were added to the developer by 0.8 wt. % to make the developer more easily flowable.

A referential numeral 32 designates a nonmagnetic development sleeve with a diameter of 16 mm, which contains a magnet 33. The above described developer 31 (+m) is coated on the peripheral surface of the development sleeve 32. It is positioned so that the distance between the peripheral surfaces of the development sleeve 32 and photosensitive member 1 becomes 500 $\mu$m, and is rotated at the same velocity as the photosensitive member 1. To the development sleeve 32, development bias voltage is applied from a development bias power source S2.

The developer 31 (+m) in the developing apparatus is borne by the development sleeve 32. As the development sleeve 32 is rotated, the developer 31 on the development sleeve 32 is regulated in its thickness by an elastic blade 34 (regulating blade), while being triboelectrically charged as it is rubbed against the elastic blade 34.

The development bias voltage is a compound voltage comprising a DC voltage of −350 V and an AC voltage which has a frequency of 1.6 kHz and a peak-to-peak voltage of 1.7 kV. As for the development process, a single component jumping development process is carried out in a development station b between the peripheral surfaces of the development sleeve 32 and photosensitive member 1. The specification of the development bias does not need to be limited to the above described one.

In order to regulate the amount of the developer 31 and also to charge the developer 31, the elastic development blade 34 is formed of elastic silicone rubber. In order to give the blade a proper amount of elasticity, the hardness of the blade was set to a hardness of 45 degrees (measured by an A type hardness meter of JIS-A=JIS-K6301), a thickness of 1.4 mm, and a reaching length of 10 mm. The contact pressure between the elastic development blade 34 and development sleeve 32 was set to approximately 30 g/cm. Further, the peripheral surface of the development sleeve 32 is coated with thermosetting phenol resin, to assist in the charging of toner.

[Transferring Process]

A referential numeral 4 designates a transfer roller as a contact type transferring means, the electrical resistance of which is in the medium range. The transfer roller 4 is kept in contact with the photosensitive member 1 with the application of a predetermined amount of pressure, forming a transfer nip c. To this transfer nip c, a transfer medium P as a recording medium is fed with a predetermined timing from an unillustrated sheet feeding portion, and a predetermined transfer bias voltage is applied to the transfer roller 4 from a transfer bias power source S3 as the transfer medium P is passed through the transfer nip c. As a result, the developer image on the photosensitive member 1 is continuously transferred onto the transfer medium P as the transfer medium P is fed into the transfer nip c.

The transfer roller 4 in this embodiment comprises a metallic core 41, and a medium resistance foam layer 42 formed on the peripheral surface of the metallic core 41. Its resistance value is $5\times10^8$ ohm-cm. For a transfer operation, a DC voltage of +3000 V is applied to the metallic core 41. As the transfer medium P is introduced into the transfer nip c, it is conveyed through the transfer nip c, being pinched by the transfer roller 4 and photosensitive member 1. As the transfer medium P is conveyed through the transfer nip c, the developer image formed and borne on the peripheral surface of the photosensitive member 1 is continuously transferred onto the top side of the transfer medium P by electrostatic force and pressure.

[Fixing Process]

A reference numeral 5 designates a fixing apparatus which employs a thermal fixing system, or the like. After being fed into the transfer nip c, and receiving the developer image from the photosensitive member 1, the transfer medium P is separated from the peripheral surface of the photosensitive member 1, and is introduced into the fixing apparatus 5. In the fixing apparatus 5, the developer image is fixed to the transfer medium P. Thereafter, the transfer medium P is discharged from the apparatus as a print or a copy.

[Cartridge]

The printer in this embodiment employs a process cartridge PC, which integrally comprises three processing devices, that is, the photosensitive member 1, charge roller 2, and developing apparatus 3, and can be removably installed in the main assembly of the printer. The combination of the processing devices integrally placed in the cartridge PC does not need to be limited to the above described one.

(2) Charge Roller 2

The charge roller 2 as a charging performance enhancement particles bearing member in this embodiment is manufactured by wrapping the peripheral surface of a metallic core 21 with a rubber or foamed material layer with a medium range resistance.

The medium resistance layer 22 is formed of a material formulated from resin (for example, urethane), electrically conductive particles (for example, carbon black), sulfurizing agent, foaming agent, and the like, and formed in the shape of a roller fitted around the metallic roller 21. After the formation, it is polished on the peripheral surface as necessary.

The measured resistance of the charge roller 2 in this embodiment was $5\times10^6$ ohm. The resistance value of the charge roller 2 was measured in the following manner: First, the photosensitive member 1 of an image forming apparatus was switched with an aluminum drum. Then, a voltage of 100 V was applied between the aluminum drum and charge roller 2, and the amount of the current which flowed between the two components was measured. Then, the resistance value of the charge roller 2 was obtained from the thus obtained current value. The measurement was carried out in an environment in which temperature was 25° C. and humidity was 60%. As far as the measurement environment is concerned, the other embodiments are the same as this embodiment.

The average cell diameter at the peripheral surface of the charge roller 2 in this embodiment was 20 $\mu$m. The average cell diameter was measured with the use of an optical microscope.

It is crucial that the charge roller 2 as a charging performance enhancement particles bearing member also functions as an electrode. In other words, not only must the charge roller 2 have a proper amount of elasticity so that it remains satisfactorily in contact with an object to be charged, but also it must have electrical resistance low enough to properly charge the object to be charged, that is, the photosensitive member 1, a moving object. On the other hand, if defective portions in terms of voltage resistance, such as pin holes, are present in the photosensitive member 1, the charge roller 2 must be able to prevent voltage leakage. When an object to be charged is an electrophotographic photosensitive member, the electrical resistance of the charge roller 2 is desired to be in a range of $10^4$–$10^7$ ohm.

The peripheral surface of the charge roller 2 is desired to have microscopic irregularities so that the charging performance enhancement particles can be held thereon.

As for the hardness of the charge roller 2, if it is lower than a certain level, the charge roller 2 is unstable in terms of shape, and therefore, the charge roller 2 fails to remain properly in contact with the photosensitive member 1, whereas if it is higher than a certain level, the charge roller 2 tends to fail to form the charge nip a against the photosensitive member 1, and even when the charge roller 2 forms the charging nip a, the state of contact between the peripheral surfaces of the charge roller 2 and photosensitive member 1 is not desirable in terms of microscopic level. Thus, the hardness of the charge roller 2 is desired to be in a range of 25–50 degrees in Asker C hardness scale.

The selection of the material for the charge roller 2 does not need to be limited to elastic foamed materials. It may be EPDM, urethane, NBR, silicone rubber, IR, or the like, in which an electrically conductive substance such as carbon black or metallic oxide has been dispersed to adjust the electrical resistance. The materials listed above may be in the natural state or in the foamed state. Further, their electrical resistance may be adjusted using ion conductive substance, instead of dispersing electrically conductive substance.

The charge roller 2 is kept pressed, against its elasticity, upon the photosensitive member 1 as an object to be charged, with the application of a predetermined amount of pressure, forming the charging nip a which is several millimeters wide in this embodiment.

(3) Charging Performance Enhancement Particles

In this embodiment, electrically conductive zinc oxide particles with a resistivity of $10^7$ ohm-cm and an average particle diameter of 1 $\mu$m are employed as the charging performance enhancement particles, which are pre-coated on the peripheral surface of the charge roller 2 as a member for bearing charging performance enhancement particles, and also as the charging performance enhancement particles externally added to the developer 31.

Whether the charging performance enhancement particles m are in the primary state of particle, that is, the state in which the particles m are physically independent among them, or in the secondary state, that is, the state in which the particles m have coagulated into particles of a larger size, there is no problem. In other words, the state of the particles m is not crucial, as long as the particles m in the coagulated state properly function as the charging performance enhancement particles.

When the charging performance enhancement particles are in the coagulated state, the average particle diameter of the charging performance enhancement particles is defined as the average particle diameter of the secondary particles. In determining the average particle diameter of the charging performance enhancement particles, 100 or more charging performance enhancement particles are randomly picked, and measured in maximum horizontal chord length, using an optical or electron microscope. Then, their volumetric particle size distribution was obtained, and the average particle diameter of the charging performance enhancement particles was defined as the 50% average based on the thus obtained particle size distribution.

If the resistance value of the charging performance enhancement particles m is no less than $10^{12}$ ohm-cm, the charging performance enhancement particles m is not as effective as otherwise. Therefore, it needs to be no more than $10^{12}$ ohm-cm, preferably, no more than $10^{10}$ ohm-cm. It was $1\times10^{7}$ ohm-cm in this embodiment. It was obtained by normalizing the values obtained by measuring the electrical resistance of the charging performance enhancement particles m by a tablet method. More specifically, approximately 0.5 g of the charging performance enhancement particle sample was placed in a cylinder with a bottom area size of 2.26 $cm^2$, and the electrical resistance of this sample was measured while applying a voltage of 100 V between top and bottom electrodes and also applying a physical pressure of 15 kg between the top and bottom electrodes to keep the sample compacted. Then, the specific resistance value of the charging performance enhancement particles m was obtained by normalizing the thus measured electrical resistance values of the charging performance enhancement particles m.

In order to prevent the charging performance enhancement particles m from interfering with the exposing process for forming a latent image, the charging performance enhancement particles m are desired to be white or nearly transparent, and also nonmagnetic. Further, in consideration of the fact that some of the charging performance enhancement particles are transferred onto the recording medium P from the peripheral surface of the photosensitive member 1, the charging performance enhancement particles are desired to be colorless or white, in particular, in color recording. Further, when the average particle size of the charging performance enhancement particles m was no less than half the average particle size of the developer 31, the charging performance enhancement particles m occasionally interfered with the aforementioned exposing process. Thus, the average particle diameter of the charging performance enhancement particles m is desired to be no more than half the average particle diameter of the developer 31. As to the smallest limit to the average particle diameter of the charging performance enhancement particles m, it is thought to be 10 nm in consideration of the stability of the particles.

As to the material for the charging performance enhancement particles m, particles of electrically conductive zinc oxide were used in this embodiment. However, the selection of the material is not limited to this one; it is possible to employ various other electrically conductive particles: particles of electrically conductive metallic oxide, for example, aluminum oxide, other than the zinc oxide, a mixture of particles of metallic oxide and organic material, and the surface treated versions of the preceding materials.

(1) Charge Injection

1) With the presence of a large amount of frictional resistance between the photosensitive member 1 and charge roller 2 in the charge nip a, it is difficult to place the charge roller 2, as a charging performance enhancement particle bearing member, in contact with the photosensitive member 1 as an image bearing member, while providing the charge roller 2 (photosensitive member 1) with a predetermined peripheral velocity relative to the photosensitive member 1 (charge roller 2). However, when the charging performance enhancement particles m are interposed between the peripheral surfaces of the charge roller 2 and photosensitive member 1 in the charge nip a, not only does the lubricative effect of the charging performance enhancement particles m make it possible to for the charge roller 2 to be easily and effectively placed in contact with the photosensitive member 1 while providing the predetermined velocity relative to the photosensitive member 1, but also the charging performance enhancement particles m compensate for the microscopic irregularities present between the peripheral surfaces of the charge roller 2 and photosensitive member 1 in the charge nip a, increasing the frequency with which the charge roller 2 makes electrical contact with the peripheral surface of the photosensitive member 1.

Providing the charge roller 2 (photosensitive member 1) with a sufficient amount of peripheral velocity relative to the photosensitive member 1 (charge roller 2) drastically increases the frequency for the charging performance enhancement particles m to contact the photosensitive member 1, making therefore drastic improvement in the state of electrical contact between the charging performance enhancement particles m and the peripheral surface of the photosensitive member 1; in other words, the charging performance enhancement particles m in the charge nip a rub the peripheral surface of the photosensitive member 1 without missing any spot. As a result, electrical charge is directly injected into the photosensitive member 1. In other words, the interposition of the charging performance enhancement particles m between the peripheral surfaces of the charge roller 2 and photosensitive member 1 in the charge nip a makes the charge injection the dominant factor among the contact type charging mechanisms.

As for the structure for providing the charge roller 2 and photosensitive member 1 with a predetermined amount of peripheral velocity relative to each other, the charge roller 2 may be rotationally driven or may be kept nonrotational whereas the photosensitive member 1 is rotationally driven. Preferably, the charge roller 2 is rotationally driven to temporarily recover and homogenize the developer particles which remained on the photosensitive member 1 after the transfer process and are being conveyed to the charge nip a. Further, the charge roller 2 is desired to be rotated in such a direction that makes the peripheral surfaces of the charge roller 2 and photosensitive member 1 move in opposite directions in the charge nip a, because temporarily separating the developer particles remaining on the photosensitive member 1 from the photosensitive member 1 by the rotation of the charge roller 2 in the direction opposite to the rotational direction of the photosensitive member 1 allows electrical charge to be more desirably injected into the photosensitive member 1.

As a result, it is possible to attain charging efficiency high enough to charge the photosensitive member 1 to a potential level substantially equal to the potential level of the voltage applied to the charge roller 2, which was impossible to attain with the use of a conventional roller based charging method. In other words, when the charging performance enhancement particles m are interposed in the above described manner, the level of the bias necessary to be applied to the charge roller 2 to charge the photosensitive member 1 to a predetermined potential level may be virtually equal to the potential level to which the photosensitive member 1 is to be charged, and in addition, it is possible to realize a safe and stable charging system or apparatus, that is, a contact type charging method and/or apparatus which does not rely on electrical discharge.

Interposing the charging performance enhancement particles m in the charge nip a in advance, and/or coating the peripheral surface of the charge roller 2 with the charging performance enhancement particles m in advance, makes a printer perform at its best in terms of the charge injection efficiency from the very beginning of each printing operation.

2) In a cleaner-less image forming apparatus, the developer particles remaining on the peripheral surface of the photosensitive member 1 after image transfer are carried, untouched, to the charge nip a by the movement of the peripheral surface of the photosensitive member 1.

However, placing the charge roller 2 in contact with the photosensitive member 1 while providing the charge roller 2 with a predetermined amount of peripheral velocity relative to the peripheral surface of the photosensitive member 1 disturbs the patterns which the developer particles remaining on the photosensitive member 1 form. As a result, the previous image pattern is prevented from appearing as a ghost in the half tone areas of the currently formed image.

3) After being carried to the charge nip a, the aforementioned transfer residual developer particles adhere to the charge roller 2. Since developer is insulative by its nature, the adhesion of the transfer residual developer particles to the charge roller 2 is one of the factors which causes the photosensitive member 1 to be insufficiently charged.

Even in such a situation, the presence of the charging performance enhancement particles m in the charge nip a makes it possible for the charge roller 2 to remain desirably in electrical contact with the photosensitive member 1, and also to maintain a proper amount of contractual resistance against the photosensitive member 1. Therefore, in spite of the contamination of the charge roller 2 by the transfer residual developer particles, electrical charge can be directly injected into the photosensitive member 1 for a long period of time; in other words, the photosensitive member 1 can be uniformly charged without producing ozone, with the application of low voltage.

4) After adhering to the charge roller 2, the transfer residual developer particles are gradually expelled from the peripheral surface of the charge roller 2, back onto the photosensitive member 1, and with the movement of the peripheral surface of the photosensitive member 1, they arrive at the development station b, in which they are cleaned (recovered) by the developing apparatus 3 at the same time as the latent image on the photosensitive member 1 is developed. The developer particles recovered by the developing apparatus is recycled.

In this case, the presence of the charging performance enhancement particles m on the charge roller 2 reduces the amount of the force with which the transfer residual developer particles adhere to the charge roller 2. As a result, the efficiency with which the transfer residual developer particles are expelled from the charge roller 2 onto the photosensitive member 1 is improved.

The process of cleaning the photosensitive member 1 while developing a latent image on the photosensitive member 1, which is mentioned above, is such a cleaning process that recovers the developer particles remaining on the photosensitive member 1 after image transfer, with the use of fogging prevention bias, that is, the difference Vback in potential level between the DC voltage applied to the developing apparatus and the electrical charge on the peripheral surface of the photosensitive member 1, during the development process of the following image forming rotation of the photosensitive member 1, that is, after the portion of the peripheral surface of the photosensitive member 1, across which the developer particles remained after image transfer are present, is charged again, and is exposed for latent image formation, in the following image forming rotation of the photosensitive member 1. In the case of reversal development such as the development process carried out in the printer in this embodiment, this process of cleaning while developing is carried out by the electrical field which acts to recover the toner particles from the regions of the photosensitive member 1 with the "dark" potential level onto the development sleeve, and the electrical field which acts to adhere the toner particles from the development sleeve onto the regions of the photosensitive member 1 with the "light" potential level.

5) The presence of the charging performance enhancement particles m borne on the peripheral surface of the photosensitive member 1, that is, the virtual adherence of the charging performance enhancement particles m to the peripheral surface of the photosensitive member 1, is effective to improve the efficiency with which the developer is transferred from the photosensitive member 1 side onto the recording medium P.

(5) Replenishment of Charge Nip a or Charge Roller 2 with Charging Performance Enhancement Particles m Even when a sufficient amount of charging performance enhancement particles m are initially interposed between the photosensitive member 1 and charge roller 2 in the charge nip a, or the charge roller 2 is initially coated with a sufficient amount of charging performance enhancement particles m, the amount of the charging performance enhancement particles m between the photosensitive member 1 and charge roller 2 in the charge nip a gradually reduces, or the amount of the charging performance enhancement particles m, gradually reduces with the usage of the apparatus. In addition, the charging performance enhancement particles m themselves gradually deteriorate with the usage of the apparatus. As a result, the performance of the charging means declines.

Thus, the charge nip a and the charge roller 2 need to be replenished with the charging performance enhancement particles m as the charging performance declines.

In this embodiment, the charging performance enhancement particles m are mixed into the developer 31 which the noncontact type developing apparatus 3 uses. Thus, the charging performance enhancement particles m are supplied onto the peripheral surface of the photosensitive member 1 in the developing station b of the developing apparatus 3, and then are carried, being borne on the peripheral surface of the photosensitive member 1, to the charge nip a, in which the charging performance enhancement particles m are interposed between the photosensitive member 1 and charge roller 2, or coated on the peripheral surface of the charge roller 2, improving the state of the contact between the peripheral surfaces of the photosensitive member 1 and charge roller 2 in terms of electrical conductivity. As a result, the charging performance of the apparatus is restored. In the case of a system such as the one in this embodiment, the charging performance enhancement particles m play the role of a contact charging member, in a practical sense. In other words, charging performance enhancing members are supplied from the developing apparatus, in a practical sense.

In the transfer nip c, the developer image on the photosensitive member 1 is pulled toward the recording medium P by the effects of the transfer bias, and therefore aggressively transfers onto the recording medium P. However since the charging performance enhancement particles m on the photosensitive member 1 are electrically conductive, they do not aggressively transfer onto the recording medium P, remaining virtually adhered to the photosensitive member 1, and are carried to the charge nip a through the transfer nip c with the movement of the peripheral surface of the photosensitive member 1.

In the developing apparatus, the charging performance enhancement particles m having been mixed into the developer 31 are rubbed against the particles of the developer 31. Since negative charge controlling substance also has been externally added to the developer 31 employed in this embodiment, the charging performance enhancement particles m are triboelectrically charged by this negative charge controlling substance to the positive polarity which is opposite to the polarity of the negative charge controlling substance. As a result, the charging performance enhancement particles m in the developer 31 on the development sleeve 32 are supplied onto the peripheral surface of the photosensitive member 1 from the development sleeve 32 by the difference in potential level between the development sleeve 32 and photosensitive member 1. Since the charging performance enhancement particles m are opposite in polarity to the developer 31, they are not transferred in the transfer station c, and therefore are supplied to the charge nip a between the charge roller 2 and photosensitive member 1, where they are coated on the peripheral surface of the charge roller 2.

(6) Uniform Distribution of Charging Performance Enhancement Particles m

In this embodiment, a sequence for shifting the position of the range, across which image forming information is written onto the photosensitive member 1, is provided for shifting the distribution pattern of the charging performance enhancement particles in terms of the longitudinal direction of the charging nip a, so that the charging performance enhancement particles are uniformly supplied onto the charge roller 2 with respect to the, longitudinal direction of the charge roller 2.

More specifically, the range on the peripheral surface of the photosensitive member 1, across which the image forming information is written by the exposing beam L projected from the scanner is shifted for every copy, so that the distribution pattern in which the charging performance enhancement particles are supplied from the developing apparatus 3 to the charge nip a is changed for every copy. Thus, even if the same image forming information is consecutively written by the exposing means L, the distribution pattern of the charging performance enhancement particles m regarding the longitudinal direction of the charging nip a changes. As a result, there will be virtually no significant deviation in the distribution of the charging performance enhancement particles m in the longitudinal direction of the charging nip a. Therefore, the charging performance enhancement particles m are evenly coated on the peripheral surface of the charge roller 2, in terms of the longitudinal direction of the charge roller 2, providing the charge roller 2 with consistency in charging performance.

(7) Evaluation of Charging Performance and the Like

After the above described image forming apparatus in accordance with the present invention was used to continuously print 500 copies with a pattern of a table illustrated in FIG. 2(*c*), it was used to print a copy of a referential image. Then, the quality of the thus obtained copy of the referential image was evaluated for indirectly evaluating the charging performance of the apparatus.

For comparison, a conventional image forming apparatus, that is, an image forming apparatus in which the position of the range on the peripheral surface of the photosensitive member 1, across which image forming information is written by the laser beam L projected from the laser scanner, was fixed, and therefore, the charging performance enhancement particles m were supplied into the charge nip a, thus, onto the peripheral surface of the charge roller 2, in a fixed distribution pattern, was tested in the same manner as the image forming apparatus in this embodiment, and the results were compared with those of the image forming apparatus in this embodiment, with respect to charging performance.

Further, the difference in the consistency with which the charging performance enhancement particles m were supplied was compared between the apparatuses in this embodiment and the conventional apparatus, by measuring the amount of the charging performance enhancement particles m remaining coated on the peripheral surface of the charge roller 2.

The method used for measuring the amount (count) of the charging performance enhancement particles m were as follows: the image forming apparatuses were stopped right in the middle of a printing operation, and the peripheral surfaces of the charge rollers 2 were photographed with a video-microscope (OVM1000N, Olympus) and a digital still recorder (SR-3100, DELTIS). The video-microscope was fitted with an object lens with 1000 multiplication.

In order to obtain particle count distributions for each of the charge roller 2, the digital images were subjected to a constant dispersion amplification process, and were rendered binary using a given threshold value. Then, the size of the total white area of each of the binary images was measured. The value of the area size drastically varies depending on the threshold value used for creating binary images. However, the particle distribution on the peripheral surface of the charge roller 2 in the longitudinal direction of the charge roller 2 can be obtained as long as the threshold value is kept constant.

Thus, the value of the amount of the charging performance enhancement particles m remaining adhered to the peripheral surface of the charge roller 2, measured in the above described method is not an absolute value, and instead, represents relative irregularity in the distribution of the charging performance enhancement particles m in terms of the longitudinal direction of the charge roller 2.

FIG. 2(*a*) shows the results of the measurement of the charging performance enhancement particles remaining adhered to the charge roller 2 of the image forming apparatus in this embodiment, that is, the distribution of the charging performance enhancement particles on the peripheral surface of the charge roller 2 in terms of the longitudinal direction of the charge roller 2 in the image forming apparatus in this embodiment. FIG. 2(*b*) shows the results of the measurement of the charging performance enhancement particles remaining adhered to the charge roller 2 of the conventional image forming apparatus, that is, the distribution of the charging performance enhancement particles on the peripheral surface of the charge roller 2 in terms of the longitudinal direction of the charge roller 2 in the conventional image forming apparatus.

As is evident from the comparison between the particle distribution particles in FIGS. 2(*a*) and 2(*b*), the irregularities in the distribution pattern of the amount of the charging performance enhancement particles m on the peripheral surface of the charge roller 2 in terms of the longitudinal direction of the charge roller 2, shown in FIG. 2(*b*), reflects a printed pattern of a table image shown in FIG. 2(*c*), whereas those shown in FIG. 2(*a*), which represents this embodiment, do not show such a tendency, proving the improper charging of the charger roller 2 is not likely to occur in an apparatus in accordance with the present invention.

The comparison in the quality of the referential image printed after the continuous printing of the table pattern, between the image forming apparatus in this embodiment and the conventional apparatus, revealed the following: in the case of the image forming apparatus in the comparative example, the charging performance of the charge roller 2 declined across the portions correspondent to the ruling lines of the table image, detrimentally affecting image quality. However, in the case of the image forming apparatus in this embodiment, the pattern in which the charging performance enhancement particles m were distributed in terms of the longitudinal direction of the charge nip a showed practically no deviation, proving that the apparatus in this embodiment could maintain desirable charging performance for a long period of time.

As described above, in this embodiment, the charging performance enhancement particles m were mixed into the developer, and were supplied into charging nip a by way of the peripheral surface of the photosensitive member 1 from the development apparatus 3. In addition, the range on the peripheral surface of the photosensitive member 1, across which the image forming information is written by the exposing beam L, was shifted for every copy in the longitudinal direction of the photosensitive member 1, so that the distribution pattern of the charging performance enhancement particles in terms of the longitudinal direction of the charge nip a was changed to make virtually uniform the distribution of the charging performance enhancement particles on the charge roller 2. As a result, it became possible to maintain desirable charging performance for a long period of time.

Incidentally, in this embodiment, the position of the range across which the laser beam L wrote image forming information was shifted for every copy. However, this practice is not mandatory. For example, the position of the image exposure, or writing, range may be shifted with intervals correspondent to a certain or irregular number of image formation cycles.

Further, electrical polarity setups in charging, developing, transferring, and the like, do not need to be limited to exactly the same setups as those made in this embodiment.

<Embodiment>

In this embodiment, a sequence for shifting the position of the charge roller 2 relative to the photosensitive member 1 is provided to shift the distribution pattern of the charging performance enhancement particles in the longitudinal direction of the charging nip a, so that the charging performance enhancement particles are uniformly supplied onto the charge roller 2 with respect to the longitudinal direction of the charge roller 2.

More specifically, the structure of the image forming apparatus in the first embodiment was modified in the following manner: the range on the peripheral surface of the photosensitive member 1, across which the image forming information is written by the exposing beam L projected from the scanner is not shifted for every copy, that is, it is fixed, and instead, the position of the charge roller as the charging performance enhancement particle bearing member is shifted relative to the exposure range of the photosensitive member 1, in other words, relative to the distribution pattern of the charging performance enhancement particles m, with regular or irregular intervals, so that the deviation in the distribution pattern in which the charging performance enhancement particles are supplied onto the charge roller 2 is virtually eliminated to uniformly adhere the charging performance enhancement particles m to the peripheral surface of the charge roller 2. As a result, consistency was realized in charging performance.

In this embodiment, the charge roller 2 was structured in such a way that it could be moved in the longitudinal direction of the photosensitive member 1 by a crank attached to one of the longitudinal ends of the metallic core 21 of the charge roller 2, although this is not illustrated in the drawings, and the position of the charge roller 2 was shifted in its longitudinal direction for every copy, with a maximum deviation of 3 mm. The aforementioned sequence corresponds to 20 copies.

Thus, even when the exposure range, or the scanning range of the laser beam L, remains the same, the pattern in which the charging performance enhancement particles m are distributed in the charge nip a varied in terms of the longitudinal direction of the charge nip a. As a result, there was virtually no deviation in the pattern, in terms of the longitudinal direction of the charge nip a, in which the charging performance enhancement particles m were distributed. Therefore, the charging performance enhancement particles m were evenly coated on the peripheral surface of the charge roller 2 in terms of its longitudinal direction, with consistency, virtually eliminating the creation of the areas, which were improper in terms of the amount of the charging performance enhancement particles m, as the contact charging members in a practical sense, on the peripheral surface of the charge roller 2. Consequently, the desirable charging performance remained consistent.

Incidentally, in this embodiment, the position of the charge roller 2 in terms of the longitudinal direction of the photosensitive member 1 was shifted for every copy. However, the frequency with which the position of the charge roller 2 is shifted does not need to be limited to one for every copy. For example, the position of the charge roller 2 may be shifted with regular or irregular intervals as necessary.

The structure, control, and the like, of the image forming apparatus in this embodiment were the same as those of the image forming apparatus in the first embodiment, except for the above described structure for shifting the position of the charge roller 2, and therefore, their descriptions will be omitted.

Figure 3:
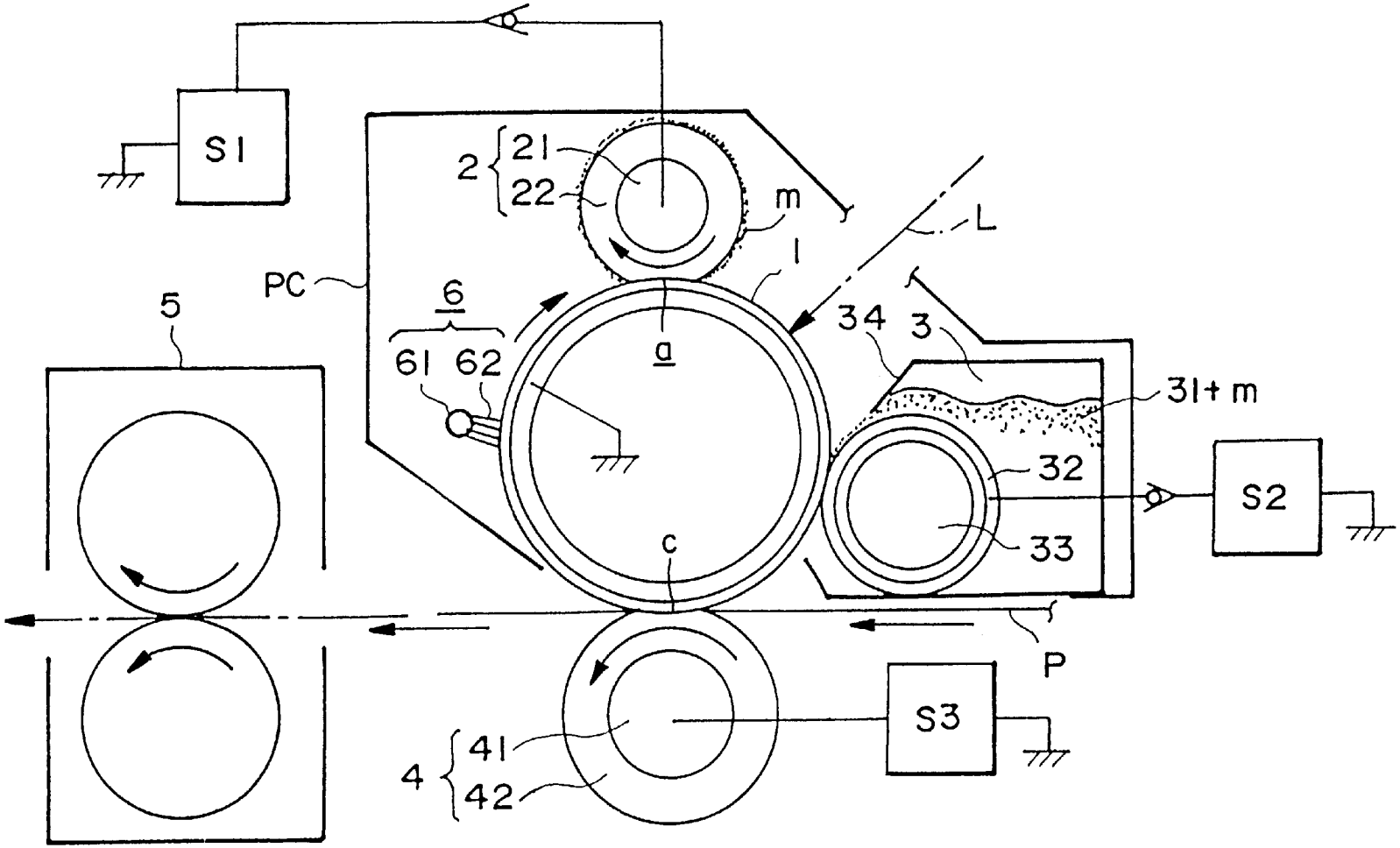
FIG. 3 is a scholastic illustration of an image forming apparatus according to Embodiment 3.

<Embodiment 3> (FIG. 3)

In this embodiment, the image forming apparatus was provided with a member for shifting the range of the peripheral surface of the photosensitive member 1, across which the charging performance enhancement particles were supplied, so that the range of the peripheral surface of the charge roller 2, across which the charging performance enhancement particles were supplied, could be shifted in the longitudinal direction of the charge nip a to make uniform the distribution of the charging performance enhancement particles on the peripheral surface of the charge roller 2 in terms of the longitudinal direction of the charge roller 2.

More specifically, the image forming apparatus in the first embodiment was modified in structure in the following manner: the range of the peripheral surface of the photosensitive member 1, in terms of the longitudinal direction of the photosensitive member 1, across which the image forming information was written by the exposing light L was not shifted, that is, it was fixed, and instead, a charging performance enhancement particle moving member 6 was provided (FIG. 3), which shifts the positions of the charging performance enhancement particles supplied onto the peripheral surface of the photosensitive member 1 from the developing apparatus 3, so that there would be virtually no deviation in the pattern in which the charging performance enhancement particles were distributed on the charge roller 2, in other words, the charging performance enhancement particles would be evenly adhered to the charge roller 2. As a result, the charging performance consistently remained as a desirable level.

In this embodiment, the aforementioned charging performance enhancement particle moving member 6 is a fur brush fixed to a supporting member 61, which is movable in the longitudinal direction of the photosensitive member 1 with the use of an unillustrated crank located at one of the longitudinal ends of the supporting member 61. In this embodiment, the position of the supporting member 61 of the charging performance enhancement particle moving member is shifted in its longitudinal direction for every copy, with the maximum deviation width being 3 mm, and each sequence being correspondent to 20 copies.

In this embodiment, the charging performance enhancement particles m are supplied onto the peripheral surface of the photosensitive member 1 from inside the developing apparatus 3. The charging performance enhancement particles m on the peripheral surface of the photosensitive member 1 are moved, that is, disturbed, by the charging performance enhancement particle moving member 6 so that the deviation in the distribution pattern of the charging performance enhancement particles m in terms of the longitudinal direction of the charge nip a is virtually eliminated. As a result, the charging performance enhancement particles m are virtually evenly adhered to the peripheral surface of the charge roller 2.

Even when the peripheral surface of the photosensitive member 1 is repeatedly exposed to the same image pattern, in other words, even when a certain level of deviation occurs to the pattern in which the charging performance enhancement particles m are distributed onto the peripheral surface of the photosensitive member 1 from the developing apparatus, the deviation is eliminated by the charging performance enhancement particle moving member 6. Therefore, it does not occur that the peripheral surface of the photosensitive member 1 is unevenly charged. In other words, it is possible to satisfactorily charge the photosensitive member 1 with consistency.

The structure, control, and the like, of the image forming apparatus in this embodiment were the same as those of the image forming apparatus in the first embodiment, except for the above described structure for shifting the positions of the charging performance enhancement particles, and therefore, their descriptions will be omitted.

<Miscellaneous>

1) The selection of the structure of the charge roller 2 as a flexible charging performance enhancement particle bearing member does not need to be limited to the structures of the charge roller 2 in the preceding embodiments.

For example, the charging performance enhancement particle bearing member may be in the form of a fur brush or the like. Further, it may be formed of felt, fabric, or the like, which is in an appropriate configuration. Further, various materials may be layered to provide better levels of elasticity and electrical conductivity.

2) An image bearing member as an object to be charged may be provided with a charge injection layer as a surface layer to adjust the electrical resistance of the peripheral surface of the image bearing member, so that the charge injection mechanism becomes dominant in charging the image bearing member.

Figure 4:
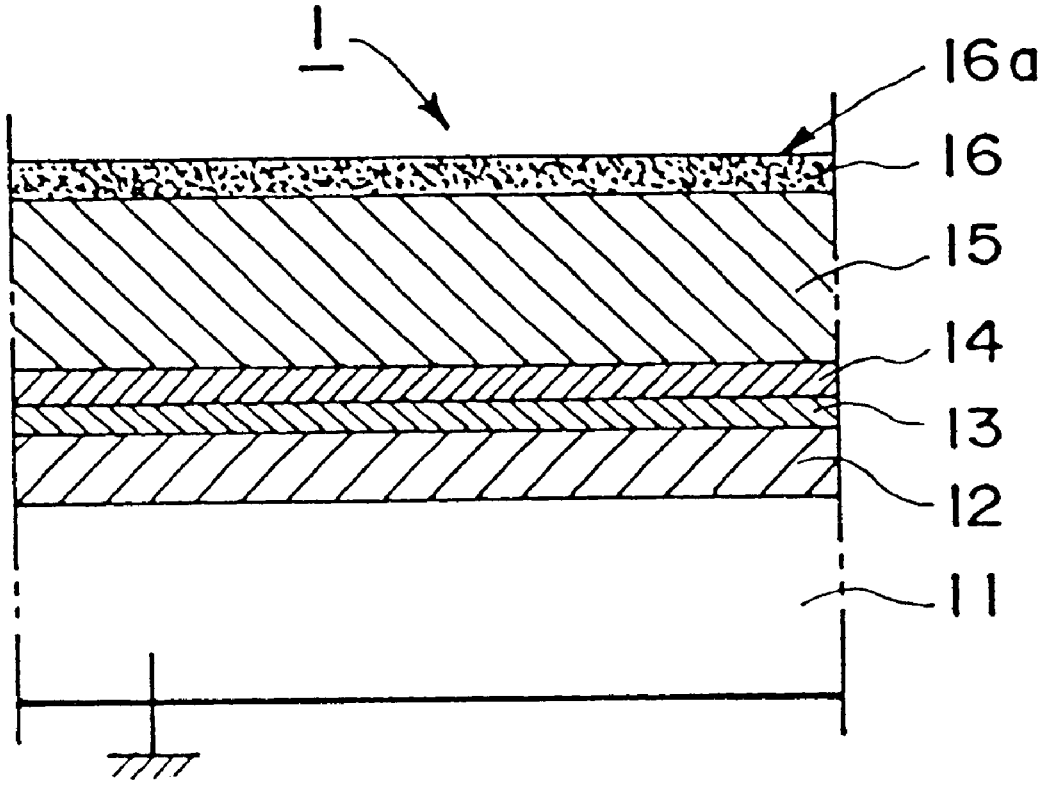
FIG. 4 shows a pattern of an example of a layer structure of a photosensitive member having a surface charge injection layer.
Figure 5:
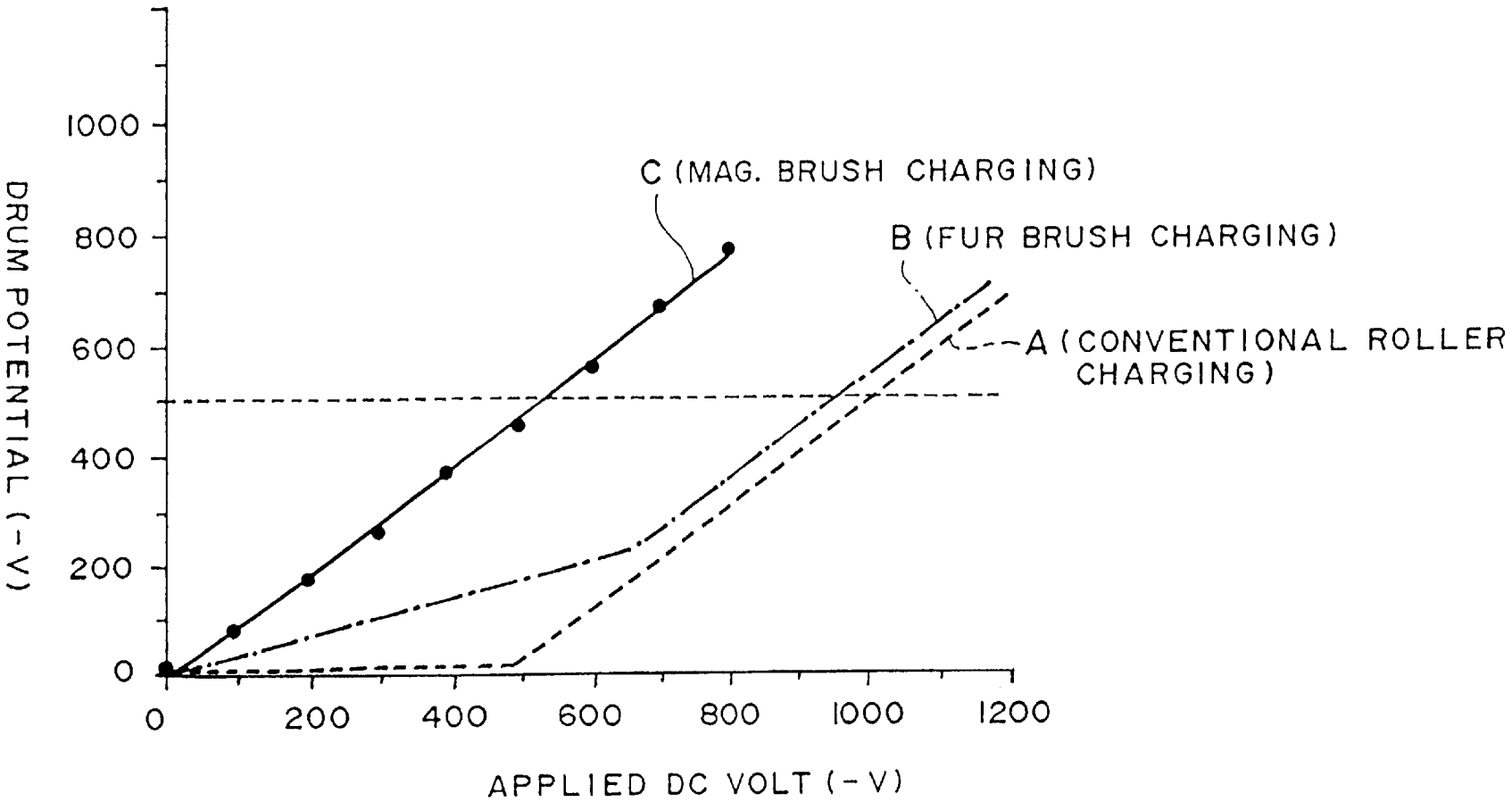
FIG. 5 is a graph of charging property.

FIG. 4 is a schematic sectional view of the surface portion of the photosensitive member 1 which has a charge injection layer 16 as the surface layer, and depicts the laminar structure of the surface portion. In other words, this photosensitive member 1 comprises an ordinary organic photosensitive member comprising an aluminum base 11 (Al drum), an undercoat layer 12, a positive charge injection prevention layer 13, a charge generation layer 14, and a charge transfer layer 15, which are coated in layers, from inward to outward, in the listed order, and the charge injection layer 16 coated on the charge transfer layer 15 to improve the chargeability of the ordinary organic photosensitive member.

The material for the charge injection layer 16 includes photo-curing acrylic resin as binder, microscopic particles 16*e* (0.03 $\mu$m in diameter) of $SnO_2$ as electrically conductive particles (electrically conductive filler, lubricating agent such as tetrafluoroethylene (commercial name: Teflon), polymerization initiator, and the like, which are dispersedly mixed. The charge injection layer 16 is formed into a film layer by being coated and photocured.

One of the essential aspects of the charge injection layer 16 is surface resistance. In the case of a system in which electrical charge is directly injected, the lower the electrical resistance on the side of an object to be charged, the higher the efficiency with which electrical image is transferred from the charger to the object to be charged. It should be noted here that when the charge injection layer 16 is a part of the photosensitive member 1, its volumetric resistivity should be within a range of $1\times10^{9}$–$1\times10^{14}$ (ohm-cm) because the photosensitive member 1 must be able to retain intact an electrostatic latent image for a predetermined length of time.

Even if a photosensitive drum is not coated with a charge injection layer unlike the photosensitive member 1 in this embodiment, an effect similar to that of the charge injection layer 16 can be produced, for example, by formulating the charge transfer layer 15 so that its volumetric resistivity falls within the aforementioned range.

Further, the usage of amorphous silicon, or the like, which is approximately $10^{13}$ ohm-cm in volumetric surface resistance, as the photosensitive material for a photosensitive member also produces the same effect.

3) When AC voltage (alternating voltage) is applied as a component of bias voltage, its wave-form may be sinusoidal, rectangular, triangular, or the like; in other words, its wave-form is optional. Further, it may have a rectangular wave-form created by periodically turning on and off a DC power source. As is evident from the preceding description, any AC voltage can be used as bias voltage as long as its voltage value periodically changes.

4) As for an exposing means for forming an electrostatic latent image, its selection is not limited to an exposing means based on a scanning laser beam such as the one in the preceding embodiments, which digitally form a latent image. For example, it may be an ordinary analog exposing means, or a light emitting element such as a LED. Further, it may be a combination of a lighting means, such as a fluorescent light, and a liquid crystal shutter, or the like. In other words, any means is usable as long as it can form an electrostatic latent image in accordance with image formation information.

The image bearing member 1 may be an electrostatically recordable dielectric member, or the like. In such a case, the surface of a dielectric member is uniformly charged (primary charge) to predetermined polarity and potential level, and then, the electrical charge on the dielectric member is selectively removed by a charge removing means such as a charge removal needle head, an electron gun, or the like, to write an electrostatic latent image reflecting a target image.

5) It is obvious that the method and structure of the developing means 3 are also not limited to those in the preceding embodiments.

6) The present invention is applicable also to an image forming apparatus equipped with a cleaner which removes from the surface of the image bearing member the developer remaining thereon after image transfer, and paper dust, after image transfer.

7) A recording medium onto which a developer image is transferred from the image bearing member 1 may be an intermediary transfer member such as a transfer drum.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member;

charging means for electrically charging said image bearing member, said charging means carrying electroconductive particles and having a charging member elastically press-contacted to said image bearing member;

image forming means for forming an electrostatic image by selectively dissipating electric charge on said image bearing member charged by said charging means;

developing means for developing the electrostatic image on said image bearing member with toner and for supplying the electroconductive particles to said image bearing member, wherein the electroconductive particles supplied by said developing means is carried to a press-contact portion between said charging member and said image bearing member; and changing means for changing a positional relationship between a position of said charging member in a longitudinal direction of said charging member and a position where the electroconductive particles are carried onto the press-contact portion, wherein said changing means includes a scattering member for scattering the electroconductive particles on said image bearing member.

2. An apparatus according to claim 1, wherein said charging member includes a surface foam layer, and a surface thereof moves in a direction which is opposite from that of said image bearing member.

3. An apparatus according to claim 1, further comprising transfer means for transferring a toner image from said image bearing member onto a transfer material, wherein said developing means collects residual toner from said image bearing member after an image transfer operation.

4. An apparatus according to claim 1, wherein the electroconductive particles are triboelectrically charged to a polarity which is opposite from a polarity of the toner by friction with toner.

5. An apparatus according to claim 1, wherein said charging means charges said image bearing member by electric charge injection substantially without electric discharge.

6. An image forming apparatus, comprising:

an image bearing member;

charging means for electrically charging said image bearing member, said charging means carrying electroconductive particles and having a charging member elastically press-contacted to said image bearing member;

image forming means for forming an electrostatic image by selectively dissipating electric charge on said image bearing member charged by said charging means;

developing means for developing the electrostatic image on said image bearing member with toner and for supplying the electroconductive particles to said image bearing member, wherein the electroconductive particles supplied by said developing means is carried to a press-contact portion between said charging member and said image bearing member; and changing means for changing a position of the electrostatic image formed by said image forming means to change a position where the electroconductive particles are carried onto the press-contact portion in a longitudinal direction of said charging member.

7. An apparatus according to claim 6, wherein said charging member includes a surface foam layer, and a surface thereof moves in a direction which is opposite from that of said image bearing member.

8. An apparatus according to claim 6, further comprising transfer means for transferring a toner image from said image bearing member onto a transfer material, wherein said developing means collects residual toner from said image bearing member after an image transfer operation.

9. An apparatus according to claim 6, wherein the electroconductive particles are triboelectrically charged to a polarity which is opposite from a polarity of the toner by friction with toner.

10. An apparatus according to claim 6, wherein said charging means charges said image bearing member by electric charge injection substantially without electric discharge.

* * * * *

UNITED STATES PATENT AND TRADEMARK OFFICE

CERTIFICATE OF CORRECTION

PATENT NO. : 6,519,433 B1
DATED : February 11, 2003
INVENTOR(S) : Jun Hirabayashi et al.

It is certified that error appears in the above-identified patent and that said Letters Patent is hereby corrected as shown below:

Title page,
Item [57], ABSTRACT,
Line 4, “elastially” should read -- elastically --.

Column 7,
Lines 56, 60 and 65, “intention” should read -- invention --;

Column 8,
Line 1, “intention” should read -- invention --; and
Line 6, “elastially” should read -- elastically --.

Column 9,
Lines 24, 34 and 39, “a” should read -- a --;
Lines 30 and 40, “a” should read -- a. --;
Line 36, “a,” should read -- a, --; and
Line 39, “makes” should read -- make --.

Column 12,
Lines 31 and 51, “a” should read -- a --; and
Line 33, “a,” should read -- a, --.

Column 14,
Lines 4, 13, 22 and 55, “a,” should read -- a, --;
Line 15, “possible to” should read -- possible --;
Lines 34 and 40, “a” should read -- a --.
Line 51, “a.” should read -- a. --.

Column 15,
Lines 11, 20 and 37, “a” should read -- a --; and
Line 30, “a,” should read -- a, --.

Column 16,
Lines 31, 40 and 47, “a” should read -- a --; and
Lines 36 and 57, “a,” should read -- a, --.

Column 17,
Lines 11, 31 and 51, “a” should read -- a --; and
Lines 36 and 57, “a.” should read -- a. --.

Column 18,
Line 11, “a,” should read -- a, --.

UNITED STATES PATENT AND TRADEMARK OFFICE

CERTIFICATE OF CORRECTION

PATENT NO. : 6,519,433 B1
DATED : February 11, 2003
INVENTOR(S) : Jun Hirabayashi et al.

It is certified that error appears in the above-identified patent and that said Letters Patent is hereby corrected as shown below:

Column 19,
Lines 21, 27 and 36, "a" should read -- a --; and
Line 56, "a," should read -- a, --.

Column 20,
Lines 23 and 59, "a" should read -- a --;
Line 26, "a," should read -- a, --; and
Line 56, "a." should read -- a. --.

Column 21,
Line 34, "a" should read -- a --.

Column 23,
Line 38, "is" should read -- are --.

Column 24,
Line 27, "is" should read -- are --.

Signed and Sealed this

Twenty-eighth Day of October, 2003

JAMES E. ROGAN
*Director of the United States Patent and Trademark Office*